United States Patent [19]

Bitko

[11] 4,135,067

[45] Jan. 16, 1979

[54] TILT SWITCH AND HOLDER

[75] Inventor: Sheldon S. Bitko, East Brunswick, N.J.

[73] Assignee: Fifth Dimension, Inc., Princeton, N.J.

[21] Appl. No.: 736,773

[22] Filed: Oct. 28, 1976

Related U.S. Application Data

[63] Continuation-in-part of Ser. No. 672,050, Mar. 30, 1976, Pat. No. 4,099,040.

[51] Int. Cl.[2] ..... H01H 35/14; H01H 29/00

[52] U.S. Cl. ..... 200/61.52; 200/61.47; 200/182; 200/186; 200/215; 200/220; 200/225; 200/226; 200/234; 335/47

[58] Field of Search ..... 200/61.47, 61.52, 182, 200/215-219, 220-226, 233, 235, 236, 186, 83 F, 211; 335/47-58

[56] References Cited

U.S. PATENT DOCUMENTS

| | | | |
|---|---|---|---|
| 1,536,439 | 5/1925 | Knutsson | 200/215 X |
| 2,145,543 | 1/1939 | Gross | 200/215 X |
| 2,450,780 | 10/1948 | Bucklen | 200/225 |
| 3,141,084 | 7/1964 | Stromberg | 200/186 |
| 3,233,093 | 2/1966 | Gerlat | 200/61.47 X |
| 3,342,965 | 9/1967 | Bosch | 200/83 F |
| 3,351,726 | 11/1967 | Cook | 200/226 X |
| 3,646,490 | 2/1972 | Bitko | 200/234 X |
| 3,978,301 | 8/1976 | Bitko | 200/222 |
| 4,001,185 | 1/1977 | Mitsui et al. | 200/61.52 X |

*Primary Examiner*—James R. Scott

*Attorney, Agent, or Firm*—Burns, Doane, Swecker & Mathis

[57] ABSTRACT

An omnidirectional tilt switch includes an enclosure for a gravity response conductive ball. An annular shelf surrounds a central depression where at least one switch contact passing into the housing is exposed. The shelf is operable to support the ball in a position resting against a cup-shaped portion of the switch housing, with the ball centroid located within a imaginary right cylinder having the inner shelf periphery as a base. In response to tilting of the switch, the ball is movable away from the cup-shaped housing to the depression where it engages the aforementioned contact and closes a circuit between that and another contact.

A switch holder mounts the switch on a substrate located, for example, in an electro-optical display-type watch. The holder includes a base with a positioning edge or surface and tabs for securing the base to the substrate. Remote from the positioning edge or surface, the switch is supported at an angle relative to the positioning edge or surface.

21 Claims, 26 Drawing Figures

FIG. 13
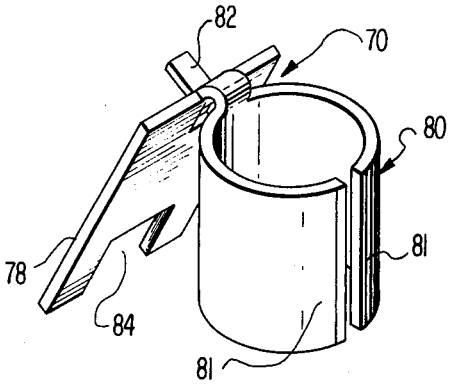
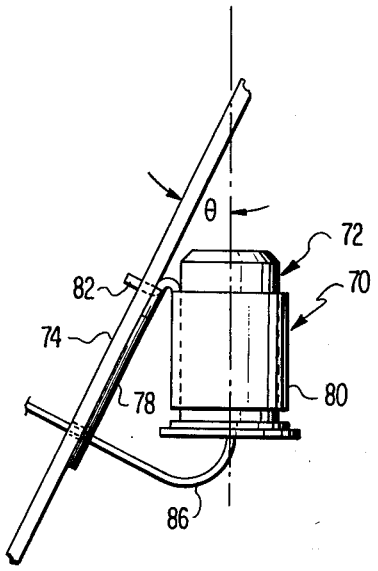
FIG. 14
FIG. 15
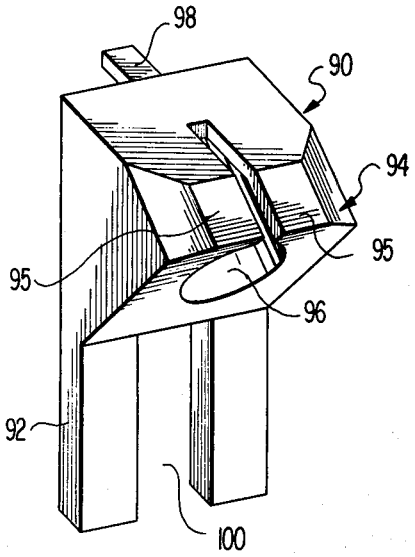
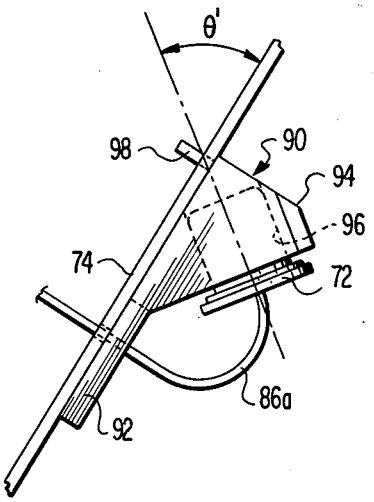
FIG. 16

FIG. 17
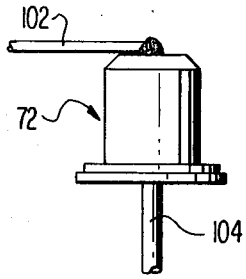
FIG. 18
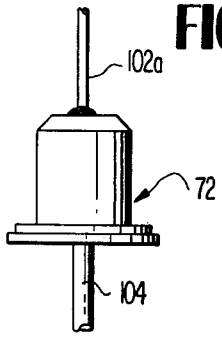
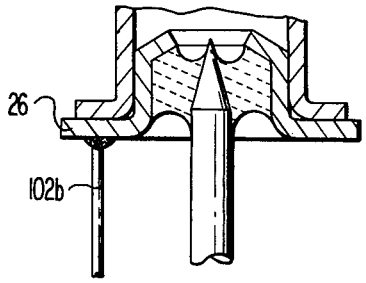
FIG. 19
FIG. 22
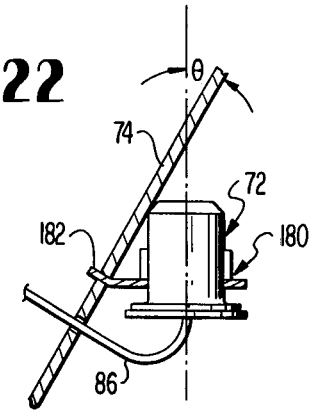
FIG. 20
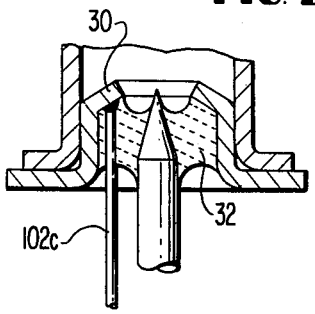
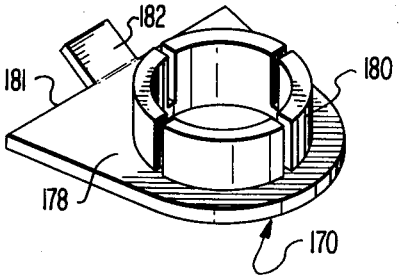
FIG. 21
FIG. 23
FIG. 24
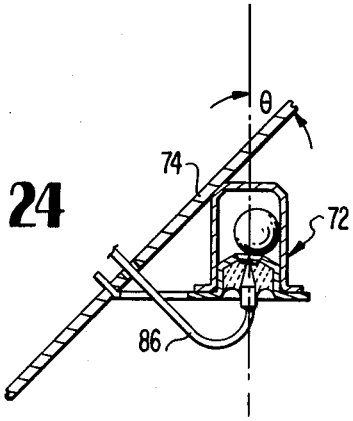
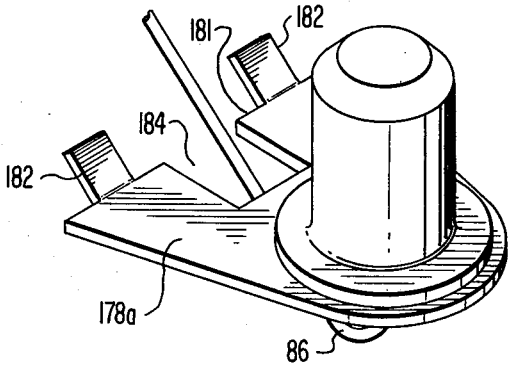

TILT SWITCH AND HOLDER

RELATED APPLICATION

This application is a continuation-in-part of my application Ser. No. 672,050 filed Mar. 30, 1976 for "Mercury Type Tilt Switch" now U.S. Pat. No. 4,099,040. The disclosure of that application is hereby incorporated by reference as if set out at length herein.

BACKGROUND AND OBJECTS OF THE INVENTION

This invention relates to tilt switches. More particularly, this invention relates to omnidirectional tilt switches, holders therefor and wristwatches utilizing the same.

A battery-operated wristwatch of solid-state components programmed to keep the time continuously has recently been developed. The watch uses an electronic display which is ordinarily operated, i.e., turned on or illuminated, only upon signal rather than continuously in order to conserve power. The display may be of a suitable type such as the light emitting diode (LED) type or liquid crystal display (LCD) type.

As pointed out in my aforementioned copending U.S. patent application, there have been several proposals for using demand switches which do not require depression or actuation by the wearer's free hand. Certain of these proposals are identified in that application, and certain of their disadvantages, such as their requirement of deliberate and unnatural arm movements and their use of substantial space, are pointed out.

My aforementioned copending application Ser. No. 672,050 U.S. Pat. No. 4,099,040, itself discloses new and improved mercury-type tilt switches that are particularly suitable as demand switches for a battery-operated wristwatch. Also disclosed therein is the use of the same in a wristwatch. As will become apparent, switches with which the present application is concerned include embodiments disclosed in that application as well as additional embodiments. Accordingly, it will be seen that my present application is likewise directed to new and improved tilt switches which are particularly suitable, both as to size and operating characteristics, for use as demand switches for a battery-operated wristwatch, and to a wristwatch utilizing the same.

While switches of the present invention of the type disclosed in my aforementioned application entail a significant advance in the art, it has been observed that the friction force opposing motion of a ball of mercury can be considerable and apparently is in proportion to the area upon which the mercury rests. Problems associated with such friction are intended to be minimized or obviated by certain additional forms of the invention disclosed herein. At the same time, those forms of the invention provide a design which enables even further miniaturization of a tilt switch.

Certain advantages of the present invention, such as small size and ease and reliability of operation, may be realizable in switch environments not involving a ball of mercury, and it is an additional object of the present invention to provide such novel switches and wristwatches utilizing the same.

Independent objects of the present invention entail the provision of novel holder constructions to conveniently mount tilt switches, particularly in electro-optical display-type watches.

SUMMARY OF PREFERRED FORMS OF THE INVENTION

Preferred tilt switches according to the present invention include a gravity responsive conductive ball and a housing defining an enclosure. for the ball. An annular shelf is disposed adjacent one end of the housing and a depression surrounded by the shelf is defined adjacent that housing end. At least one switch contact extends through the housing and is exposed at the depression. An additional switch contact, such as an additional contact projecting into the housing or the shelf itself, is also provided.

The annular shelf is operable to support the ball in a position where it rests against a portion of the housing which projects beyond the shelf. Preferably this housing portion takes the form of the internal wall of a cup-shaped housing section. In response to the orientation of the switch, the ball is movable to a position unsupported by that housing portion and in contact with both the switch contacts. The switches are particularly useful to operate the display of electro-optical display-type wristwatches in this condition.

Where the shelf is one switch contact, it is preferably defined by an inwardly sloping ledge terminating in a narrow annular edge. The ball is dimensioned to preclude passage into the depression out of contact with the shelf edge.

Solid conductive balls and liquid conductive balls are envisioned, as are contacts with pointed and flat tips. The ball is freely movable in the enclosure between a position wherein it is not operable to close an electrical circuit between two particular switch contacts, at least one of which is in the depression, and a second position where it is operable to close that circuit. When the preferred switch is oriented only within a solid angle including a generally upright position, that second position is assumed. The first position is attained with certain orientation conditions outside the solid angle.

The edge of the shelf constitutes the preferred means for establishing a knife-edge support for the ball, although the edge need not necessarily be formed by a shelf. At any rate, the edge constitutes a fulcrum for supporting the ball in a condition of unstable equilibrium such that the switch is operable to toggle between two states corresponding to the two aforementioned ball positions.

Enclosures for the ball preferably take the form of a cuplike cap and a header. The header includes an inwardly extending, peripheral flange portion presenting the shelf, and a central closure portion of insulating material sealed within the peripheral portion. The central closure portion is recessed relative to the shelf to define a depression.

Preferred switch holders for mounting the switches on a substrate located, for example, in a watch include a base and one or more tabs for securing the base to the substrate. These may be solder tabs. The base presents a positioning portion engageable with the substrate. The positioning portion may comprise a planar face of the base or an edge of the base containing the tab. Remote from the positioning portion the switch is supported at an angle relative to the positioning portion.

Support of the switch at an angle may be by a clamp for releasably gripping the switch. In the case where a positioning surface is employed, the clamp may be attached to the body in a fixed orientation relative to that surface, or it may be attached for limited pivoting to alter its orientation relative to that surface.

Where a positioning edge is employed, the support for the switch may comprise a portion of the switch housing, for example, a section of the header, integral with the base. Alternatively, the support may comprise a tubular clamp mounted on the base and projecting from it at a location spaced from the positioning edge. The clamp is operable to grip the switch in a position where a housing portion, for example the cap, projects through the base. The tab is bendable relative to the positioning edge for ease in soldering. The orientation of the switch relative to the substrate is controllable by altering the projection of the switch and changing the angle of the base relative to the substrate at the positioning edge.

Additional objects, advantages and details will become apparent from the subsequent detailed description of preferred forms of the invention in connection with the accompanying drawings.

BRIEF DESCRIPTION OF THE DRAWINGS

FIG. 13 is a perspective view of one form of a clip or holder in accordance with the invention for positioning a tilt switch on a substrate;

FIG. 14 is a side elevational view on a reduced scale showing the clip of FIG. 13 positioning a tilt switch in accordance with the invention in position on a substrate for a battery-operated wristwatch of the type providing an electro-optical display;

FIG. 15 is a perspective view of a modified form of clip or holder in accordance with my invention;

FIG. 16 is a side elevational view on a reduced scale showing the clip of FIG. 15 positioning a tilt switch on a substrate for a battery-operated wristwatch of the type providing an electro-optical display;

FIGS. 17 through 20 show, in elevation or partial sectional views, various constructions by which an electrical connection may be made to a second terminal of the preferred forms of my tilt switch;

FIG. 21 is a perspective view of another form of holder in accordance with my invention;

FIG. 22 is a side elevational view showing the clip of FIG. 21 in position on a substrate for a battery-operated wristwatch of the type providing an electro-optical display;

FIG. 23 is a perspective view of another form of holder in accordance with my invention; and FIG. 24 depicts in side elevation the clip of FIG. 23 in position on a substrate for a battery-operated wristwatch of the type providing an electro-optical display.

DETAILED DESCRIPTION

Figure 1:
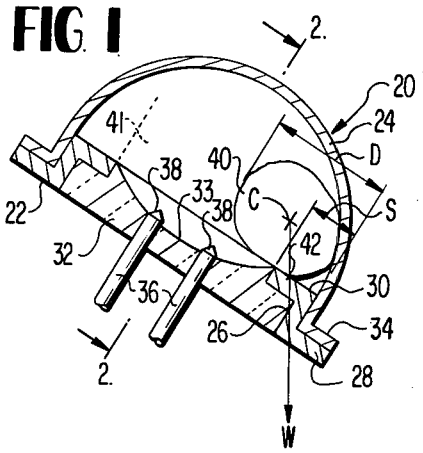
FIG. 1 is a sectional view taken along the line 1—1 of FIG. 3 of a preferred form of switch in accordance with my invention, with the switch being shown at an angle from an upright position.

Referring to FIGS. 1 through 4, the illustrated switch 20 according to the present invention includes a casing or housing defining an enclosure and made up of a header 22 and a cuplike cap 24 shaped like a dome. The header 22 includes a peripheral portion of metal comprising a cylindrical ring portion 26, an outwardly extending circular flange 28, and an inwardly extending flange 30 presenting an inwardly extending annular shelf or ledge 42. Centrally disposed within the peripheral portion of the header in bonded, sealed relationship therewith is a central seal portion 32 which is preferably of glass but may be of a ceramic or plastic insulating material having similar properties. The dome-shaped cap 24 is preferably also of metal and is provided with a flange 34 welded to the flange 28 of the header to seal the enclosure. A pair of spaced electrodes 36 extend through the glass seal 32 in sealed relationship thereto with tips 38 thereof extending into the sealed enclosure. A movable conductive ball in the form of globule 40 of liquid conductive material having high surface tension, preferably mercury or mercury having a small amount of one or more materials therein to lower its surface tension (e.g., caesium or potassium), is disposed in the enclosure.

Figure 2:
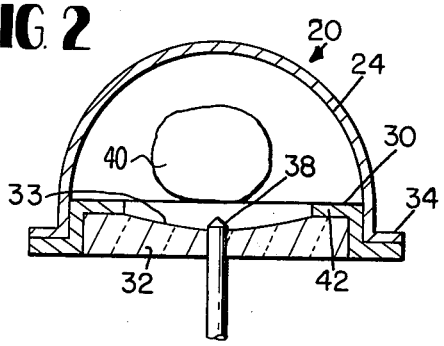
FIG. 2 is a sectional view of the switch of FIGS. 1 and 3 taken along the line 2—2 of FIG. 1.
Figure 1A:
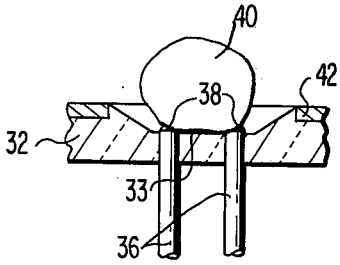
FIG. 1*a* is a partial sectional view corresponding to FIG. 1 of another form of switch according to my invention, but showing the switch in closed condition.

The upper surface of the glass seal 32 of the header is recessed relative to the shelf 42 to define a depression 33 surrounded by the inner edge of the shelf. The dished seal 32, which provides the depression 33, is adapted to seat the globule in the upright position of the switch with the header substantially horizontal. The depression 33 may be provided in any suitable manner such as in the form of a wall sloping to a lowermost central concavity as illustrated in FIGS. 1 and 2, or in the form of walls tapering to a central flat as shown in FIG. 1*a*. The tips 38 of the electrodes 36 may be more or less symmetrically disposed about the center of the seal 32. The spacing of the electrode tips 38 and the size of the globule 40 are so related that when the globule is seated, the electrode tips are bridged by the globule to close an electric circuit therebetween.

As will be appreciated, when the switch is oriented in positions where actuation is not desired, the globule 40 may rest on the shelf 42 formed by the generally radially projecting flange 30. As shown in FIG. 1, the radial extent or width S of the annular shelf 42 is less than one-half the diameter D of the globule 40 that provides the movable conductive ball. In such instances, with the ball 40 supported on the shelf 42 and against the internal wall of the cap 24, the centroid C of the ball 40 lies within an imaginary right circular cylinder having the internal circular edge of the shelf 42 as its base. This imaginary cylinder is indicated at 41 in FIG. 1.

Figure 4:
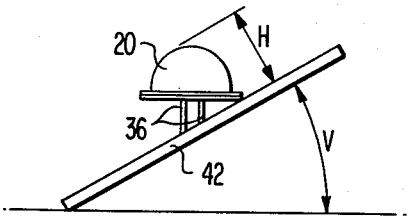
FIGS 4 and 4*a* are diagrammatic views on different scales representing a switch according to my invention mounted on a printed circuit board constituting part of a solid-state wristwatch.
Figure 4A:
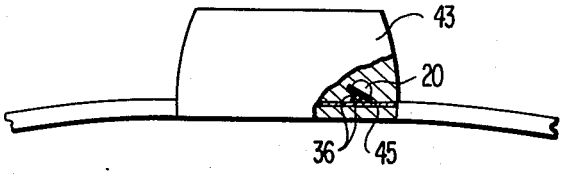

In use in a wristwatch, the switch will ordinarily be disposed at an angle to the watch face such that the switch is in horizontal or upright position (see FIG. 4) when the wristwatch is at substantially the center of the solid angle of orientation in which it is usually viewed by a wearer. FIGS. 4 and 4*a* show a manner in which the switch may be secured to a printed circit board 45 of a solid state wristwatch 43 by means of the electrodes 36 of the switch, although other supporting arrangements may be used. In FIG. 4, the angle V represents substantially the center of the viewing angle desired in which the plane of the paper may, for example, represent the plane perpendicular to the face of the watch passing through what would be the six and twelve o'-clock positions of a conventional watch. The switch may also be tilted to a preferred angle in the plane perpendicular thereto. Different angles of operation of the switch may be desired in the two perpendicular planes. For example, one may desire an operating or viewing angle of about 0 to 50 degrees in one plane and about 10 to 20 degrees in the other. The precise manner of mounting and orienting the switch to provide the desired angular operating characteristics will be apparent to one skilled in the art.

Figure 3:
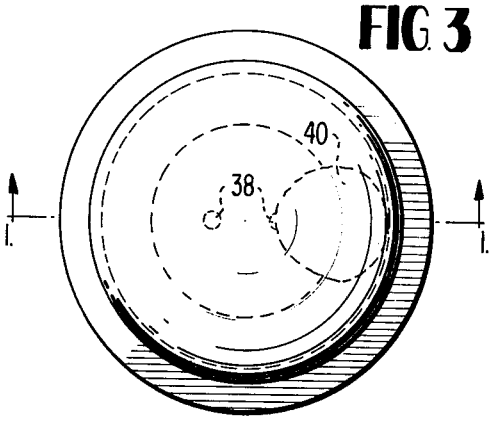
FIG. 3 is a top plan view of the switch of FIG. 1.

When a switch in accordance with FIGS. 1 to 3 is installed in a wristwatch as described, the arm of the wearer will ordinarily be in positions either which result in the globule 40 being in engagement with the surface of the shelf 42 and the interior of the wall surface of the cap 24 (see FIG. 1) or which result in the globule 40 resting solely on that interior wall surface. In either event, the globule will be lower than the depression or seat 33 as the wearer moves his arm to bring the wristwatch to the usual viewing position tilted somewhat to the horizontal. As the movement progresses, the globule will ordinarily reach a position as shown in FIG. 1. In that position more than half of the globule weight is acting outside the inner edge of the annular shelf 42. Further tilting of the watch through the horizontal position of the switch will position the center of the globule so that most of its weight acts to inside the edge of the shelf and cause the globule to move into the depression 33 to bridge the electrodes 36. The latter position is shown in FIG. 1*a*.

In other words, when the weight vector of the ball 40 does not pass through the bottom of the imaginary cylinder 41, the ball 40 will either be supported by the cap 24 or by the cap 24 and the shelf 42. Such a situation is shown in FIG. 1, with the weight vector being indicated by W. However, as will be apparent, when the watch is oriented such that the weight vector W acts through the bottom of the imaginary cylinder 41, the ball moves into the depression 33.

In this switch of FIGS. 1 to 3, the controlling parameters appropriate for movement of the globule into and out of the depression 33 are the width S of the shelf, the diameter D of the globule, and the depth of and slope to the depression. The critical angle for seating of the globule in the depression 33 is the point where the weights of the portion of the globule on each side of the inner rim are equal, i.e., where the weight vector W acts through the periphery of the edge of the imaginary cylinder 41, namely, directly at the inner edge of the shelf 42. The depression depth and slope enter into consideration in connection with movement of the globule out of the depression 33, and by appropriate selection of these parameters, opening characteristics of the switch can be optimized. Thus, the critical angle may be selected in constructing the switch by relating the dimensions S and D and the depression depth and slope. Additionally, the spacing of the terminals and depression diameter will play a part in optimizing operating characteristics.

Of course, the diameter of the globule is a function of weight or quantity of the mercury in the globule. Therefore, switches according to FIGS. 1 to 3 having the same mechanical dimensions in other respects may be provided with different critical operating angles within a desired range by varying only the amount of mercury in the globule provided. As will be apparent, this in turn will vary the offset of centroid C of the ball, when it is supported on the shelf, from the centerline of the imaginary cylinder 41. Of course, the switch angle at which the weight vector W will act through the base of that cylinder accordingly is varied.

It is significant that the switch can be opened by a movement of the arm carrying the wristwatch that is the reverse of the movement of the arm to reading position. As such, no unusual or unnatural movement of the arm or wristwatch is necessary to operate the switch in either direction. In this connection, the sizing and spacing of the switch elements such that the centroid C of the ball 40 lies within the imaginary cylinder 41 when the ball is supported on the shelf 42 has been found to be quite desirable. In structures where this is not the case, the ball 40 might well have a tendency to bypass the depression 33 and travel around the rim established by the shelf 42, to a point of its lowest potential energy, on occasions when seating in the depression is instead desired. When the ball 40 and shelf 42 are sized such that the centroid C of the shelf supported ball overlies the depression (i.e., lies within the imaginary cylinder 41), the possibility of this tendency is essentially eliminated. With a switch of the structure of FIG. 1, the centroid C is inherently located in the imaginary cylinder 41 when the radial extent S of the shelf is less than one-half the diameter D of the globule.

While it is contemplated that a switch similar to that of FIGS. 1 to 3 may be made with the header 22 and cap 24 of glass, ceramic materials or plastics, such materials result in a number of disadvantages over my preferred construction, particularly for a switch of very small dimensions that is required to provided uniform and accurate performance. I therefore prefer to construct the header and cap of my switch of metal as already stated. Further, it is particularly advantageous in most circumstances that the metal is of a composition, or has an inner surface of a composition, that is not mercury-wettable and not subject to becoming mercury-wettable in spots or areas with continued use. The interior of the switch is sealed free of oxygen which would tend to cause degradation. Also, an inert gas may be provided in the switch if desired. Since the header 22 and cap 24 are welded together at their flanges, it is also important that the metal have a proper electrical resistance to permit satisfactory welding at that location.

In the past, a known chromium-containing alloy on which a chromium oxide is produced by heating in wet hydrogen to form a suitable layer of ionically combined oxygen has been used for contacts of a nontilt-type mercury switch. I have found that this material provides good results when used as the metal header and cap, since the resulting oxide will not "outgas", that is, it will not permit release of oxygen into the interior of the switch. While a number of chromium-bearing materials can be used, those with a sufficiently small amount of chromium as to result in an oxide having an electrical resistance that can be easily overcome during welding are preferred. My preference for the header and cap material is Carpenter 42-6 alloy, also known as Sylvania #4, which material contains 42% nickel, 6% chromium and the remainder iron. That material is preferably oxidized as discussed above to avoid "outgassing" problems that occur in cases where some nickel-cobalt-iron alloys having an oxide formed in molecular oxygen rather than in wet hydrogen are used. The material is also highly suitable as the glass sealing alloy for sealing the center portion 32 in the header. As an option, the interior surfaces of the metal header and cap may be clad with a metal such as tantalum to enhance its non-wetting characteristics.

The glass surface of the center 32 of the header is ordinarily naturally mercury-unwettable, as is preferred.

Since the switch is to be operable at low voltage and low current, it is desirable that there be low resistance contact between the mercury globule 40 and the tip portions 38 of the electrodes as will be attained when the tips are mercury-wettable and glass-unwettable.

Figure 5:
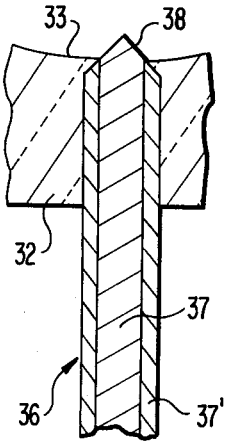
FIG. 5 is a partial sectional view on an enlarged scale of a preferred form of electrode structure in place in the switch of FIG. 1.

A preferred electrode construction is shown in FIG. 5. The electrode 36 includes a central core 37 covered by a sheath or jacket portion 37'. The core is preferably of a nickel-copper allow which is mercury-wettable but not glass-wettable. It is preferably of small diameter, as from 0.004 to 0.005 inches. The jacket is preferably of the previously-mentioned Carpenter 42-6 alloy, also known as Sylvania #4, and may be oxidized as described in connection with the header and cap construction. Being glass-wettable, the latter material provides good bonding between the electrode sheath and the glass. The tips 38 are preferably pointed as shown, and in the preferred construction only the mercury-wettable core portion of the tip extends above the glass surface. It is preferred that this extending portion be maintained as small as possible to avoid undue impedance to desired movement of the mercury. Tip protrusions of 0.004 inches or less with a diameter of 0.004 inches or less are preferred. Although the pointed tips 38 make good electrical contact with the mercury globule, their small size prevents them from providing significant surface tension adherence to the globule such as might cause the mercury to string out during opening of the switch. Even if a slight tendency toward stringing out were to occur, it will not impair the operation of the two-electrode switch since complete disconnection of the globule is only necessary at one of the electrodes to interrupt the bridging between them.

Figure 6:
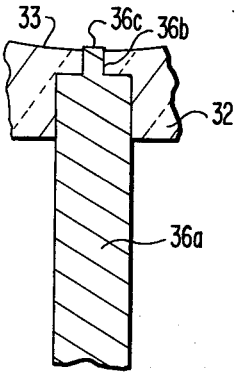
FIG. 6 is a partial sectional view on an enlarged scale of a modified form of electrode structure.

FIG. 6 shows an alternative electrode structure. In this arrangement, a solid wire electrode **36*a* of glass-wettable metal such as the Carpenter 42-6 alloy is reduced to a smaller diameter at its upper end 36*b* which preferably ends substantially flush with the surface of the glass depression 33**.

The electrodes 36 may be made in the form of fine wires having a diameter of between 0.003 and 0.006 inches and ground substantially flush with the surface of the glass depression 33 at their upper ends. The ends may be electroplated at **36*c*** with a mercury-compatible metal so as to make the contact mercury-wettable.

As will be appreciated, the two-electrode switch already described permits selection of different angles of acceptance or closure in the directions in line with the electrodes and in quadrature thereto. In a plane normal to the plane including the electrodes 36, the globule bridges the electrodes between two positions of the globule encompassing nearly twice its diameter. In the plane including the electrodes, movement of the globule only a slight distance from the central position will separate one of the electrodes from the globule, leaving an angle of closure or acceptance only slightly greater than the diameter of the globule. The spacing of the electrodes and the size of the globule are thus two parameters which may be varied to control this effect to provide the desired asymmetry in the solid angle of closure of the switches of the three embodiments already described. It is further possible to vary the center of the solid angle of closure of the electrodes by spacing them off-center relative to the upright or vertical axis of the switch.

In addition to the preferred forms of my invention using two electrodes as described above, certain switches may also be provided using one electrode extending into the enclosure, with the switch housing itself forming the other switch contact. FIGS. 7–11 depict such switches, and FIG. 12 depicts a watch containing a switch of this type. In these figures, the elements similar to those previously described are identified by reference characters in the "100" series. In certain instances, the last two digits correspond to the reference character used to designate the similar earlier-described elements. Some of the elements among FIGS. 7 and 9–11 are further differentiated by letters following the numerical designation.

As will become apparent, each of the switches in FIGS. 7 and 9–11 shares in common with the previously-described switches the feature whereby the centroid of the movable ball, when supported on the shelf, lies within an imaginary circular cylinder containing the inner edge of that annular shelf. In this fashion, seating of the ball in the depression is enhanced in desired switch orientations as pointed out above. Additionally, as will be noted in connection with the subsequent description, the switches of FIGS. 7 and 9–11 include a knife-edge at the inner shelf edge. The knife-edge is intended to provide a support for the ball in a condition of unstable equilibrium so that rolling friction of the ball is essentially eliminated and a toggle action of the switch is possible.

Figure 7:
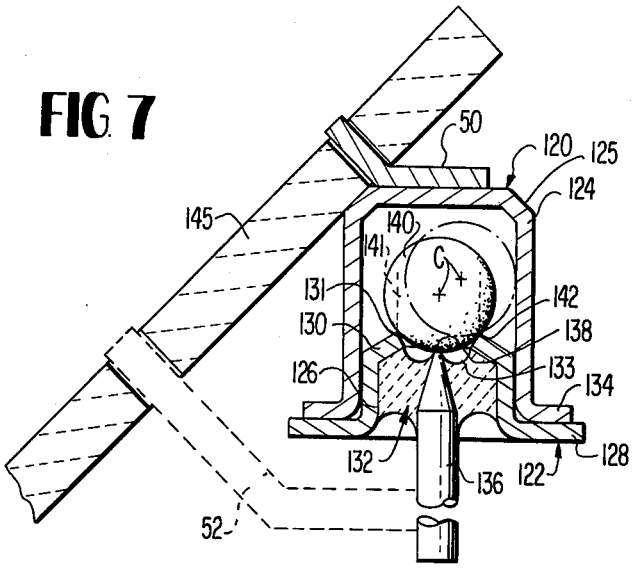
FIG. 7 is a view of a preferred form of another embodiment of a switch in accordance with my invention shown in section taken along the line 7—7 of FIG. 8 and associated with a mounting board, with a movable ball of mercury being depicted in two different positions.
Figure 8:
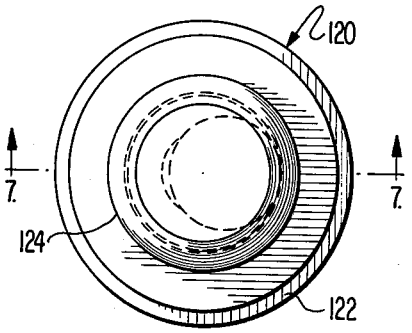
FIG. 8 is a top plan view of the switch of FIG. 7.

Referring to FIGS. 7 and 8, the illustrated switch 120 includes a casing or enclosure made up of a header 122 and a cuplike cap 124 of generally cylindrical configuration, with a beveled top end 125. As in the case of the switch of FIG. 1, the header 122 includes a peripheral portion of metal comprising a cylindrical ring portion 126, an outwardly extending circular flange 128, and an inwardly extending flange 130 presenting an inwardly extending annular shelf or ledge 142. A central seal portion 132 of insulating material is also provided, as is a central electrode 136 which is preferably constructed as the electrode of FIG. 5. The metal cap 124 has a flange 134 welded to the header flange 128. A movable conductive ball in the form of a globule 140 of the liquid conductive material is disposed in the enclosure.

The switch 120 of FIGS. 7 and 8 differs from the switch of FIG. 1 in several significant aspects. In particular, the shelf 142 is generally frustoconical and is inclined upwardly toward the center of the switch. Moreover, while the glass seal 132 is recessed relative to the shelf 142 to provide a depression 133, as in the case of FIG. 1, the relationship between the seal and shelf is such that the inner perimeter of the shelf is exposed and presents a thin, sharp edge 131 resembling a knife-edge. Whenever the ball 140 is in the depression 133, it is "penetrated by " the contacting electrode 136 and still remains in contact with the knife-edge 131. At the same time, the relationship between the shelf 142, the cap 124 and the ball 140 is such that when the ball is supported by the shelf, it is supported on the knife-edge 131 and against the cap, rather than on a significant portion of the surface of the shelf. This is shown by the phantom illustration of the ball in FIG. 7.

As noted earlier, when the ball is supported on the shelf, the centroid C lies in the imaginary right circular cylinder 141 which has the edge of the shelf as its base. This enhances the operating characteristics as described above. Additional advantages are, however, provided by the toggle action of the switch of FIG. 7 and the relatively smaller size which the design readily facilitates. Namely, the fine control of the opening and closing angles of the switch can be attained, and enclosure volume can be constructed not greatly in excess of the ball volume.

In its movement into and out of the depression 133, the ball 140 makes substantially line contact with the knife-edge 131, which act as a fulcrum about which the ball 140 moves with a minimum of friction. Since the small size of the mercury ball which is to be employed is chosen such that its weight does not produce significant rolling friction by sagging over either side of the fulcrum 131, it is believed that in switches of the design of FIG. 7 it will be possible to use a mercury ball of as little as 15 to 20 mg. of mercury. Hence, a small housing especially suitable for use as a component in a wristwatch can be employed. The ball size is so small that it approaches spherical shape, but the dimensions of the switch parts are such as to preclude loss of contact of the ball with the knife-edge when the ball is in the depression.

While the switch 120 of FIG. 7 where the inclined shelf 141 terminates in a knife-edge that supports the ball optimizes the reduction of friction as compared with the switch 20 of FIG. 1 where the ball rests on the shelf, it will be appreciated that in accordance with the present invention useful friction reductions that enhance operation can be provided by upwardly inclining the shelf 41 of the FIG. 1 type switch without necessarily arranging the parts such that the ball does not rest on the shelf proper. Because of the surface tension less of the ball will rest on an inclined shelf, thus reducing problems associated with friction.

Practical switches of the construction of FIGS. 1–4 have been made with a diameter between 0.180 and 0.250 inches and a height of about 0.175 inches. Even smaller switches, with a diameter as small as 0.093 to 0.135 inches and a height about 0.120 inch or less, are believed practical with the embodiments of FIGS. 7–11.

When used in a wristwatch, the switch 120 will ordinarily be disposed at a selected angle to the watch face such that the switch is in the "horizontal or upright" position when the wristwatch is at substantially the center of the solid angle of orientation in which it is usually viewed by the wearer. FIG. 7 shows the switch provided with one type of external terminal members to facilitate mounting the switch in the desired positon in a wristwatch. Thus, conductive terminal members 50 and 52 are respectively secured, as by welding, to the metal cap 124 and the electrode 136. By means of these terminal members 50 and 52, the switch may be mechanically supported by and electrically connected at the desired angle to the printed circuit board 145. Alternatively, the terminal 52 may be dispensed with and the electrode 136 may be elongated and bent around the substrate 145 for direct connection thereto.

Referring to FIG. 12, it will be seen that the circuit board 145 may be mounted in a watch case 143 in a position substantially parallel to the viewing face of the watch. Through appropriate shaping and twisting of the external terminal members 50 and 52, the switch may be appropriately tilted relative to the watch face by the same or different amounts in perpendicular directions (e.g., what would be the six to twelve o'clock and the three to nine o'clock directions in a nondigital type of watch). Different angles of operation may be desired in the two perpendicular planes. A preferred form of the switch may be designed to operate to close the circuit between the contact 136 and the contact provided by the knife-edge 131 when the switch tilt is reduced to within a predetermined angular orientation relative to its horizontal or upright position, that is, when the upright axis comes within a predetermined solid angle to the vertical. As in the case of the previously-described switch, the precise manner of mounting and orienting the switch to provide the desired angular operating characteristics will be apparent to one skilled in the art.

When a switch in accordance with FIGS. 7 and 8 is installed as described in connection with FIG. 12, the arm of the wearer will ordinarily be in positions which result in the ball or globule 140 being supported out of contact with the central electrode 136, either on the fulcrum 131 and against the cap 124, or solely against the cap 124. In either case, as the wearer moves his arm to bring the wristwatch to the usual viewing position, tilting of the watch toward horizontal or upright position of the switch will result in the condition where most of the weight of the globule is acting on the inside of the knife-edge perimeter 131. As this shift in the acting direction of the weight relative to the depression 33 occurs, the globule will rapidly move about the knife-edge fulcrum from the relative position depicted in phantom in FIG. 7 to the position shown in full line.

In this position, the globule is out of contact with the cap 124 and in contact with the fulcrum 131 and the electrode 136. The fulcrum 131 is in electrically conductive relationship with the cap 124 since the metal header flange 128 is welded to the metal cap flange 128. Thus, in the full line position of FIG. 7, the ball 140 establishes an electrical circuit between the electrode 136 and the cap 124, and hence between the terminals 50 and 52.

It will be appreciated that, if desired, in switches according to FIG. 7 and FIGS. 9–11 described in more detail below, multiple electrodes can be located in the depression to effect closure of the switch without reliance on the cap 124 as a conductor. Moreover, by interposing a suitable insulator between the header 122 and cap 124, it is believed possible to provide a single pole, double throw switch utilizing the header 122 and cap 124 as separate contacts. This might require providing access for the ball into the housing through aperture in the cap 124 that is subsequently sealed. It is also envisioned that a single pole, double throw switch or even a normally open switch could be provided by eliminating the shelf section 142 of the header and glassing in a metal cylinder between the contact 136 and the header cylindrical section 126. The cylinder would present a knife-edge located above the depression 133 and would provide a contact electrically isolated from and spaced from the housing. Other arrangements will also be envisioned, but the preferred arrangement, at least for watch applications, is shown.

Figure 9:
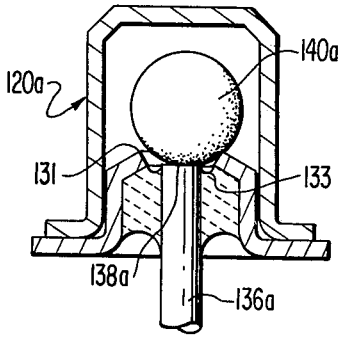
FIG. 9 is a sectional view of a modified form of switch in accordance with my invention.

FIG. 9 depicts a switch 120*a* similar to that of FIG. 7 but modified by the use of an electrode 136*a* having a substantially flat upper end 138*a* instead of a pointed tip. The ball 140*a* is, of course, sized to be able to move into the depression 133 beneath the knife-edge 131 so as to contact the flat end 138*a* of the central electrode 136*a*, without losing contact with the knife-edge. The flat contact end 138*a* is intended to provide ample contact surface with the mercury ball 140*a*. Therefore the end is preferably unwetted by mercury to minimize retardation of switch operation. When the ball is in contact with the electrode 136*a*, substantially the entire perimeter of the ball will be in line contact with the knife-edge.

Figure 10:
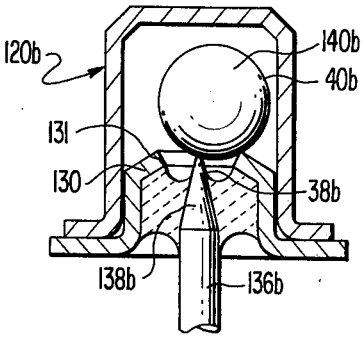
FIG. 10 is a sectional view of another modified form of switch in accordance with my invention.

FIG. 10 shows a modified switch 120*b* using a metal ball 140*b* of suitable conducting material, instead of a mercury globule, as the freely movable conductive element. The ball 140*b* is preferably of a nonmagnetic material, e.g., "Monel" or brass, and is provided with a coating or plating 40*b* of highly conductive metal such as gold. Additionally, the central electrode 136*b* preferably has a pointed end 138*b* provided with a gold plating or coating 38*b*. If desired, the edge of the inner periphery of the frustoconical header flange 130 including the knife-edge 131 is also gold plated.

The switch 120*b* is designed to provide togglelike switching action similar to the previously described switches, with fulcrum acting taking place about the knife-edge to permit rapid switching action with precise control of the switching action. When the ball 140*b* falls over the ledge, it is supported in part by the knife-edge 131 and in part by the pointed end 138*b* of the electrode. Again, loss of contact with the knife-edge is precluded. Line contact and point contact of the knife-edge 131 and the electrode tip 138*b* are essentially respectively established, and togglelike switching action should permit attainment of a switch of minimum size. It is, of course, envisioned that materials having similar properties may be used in place of "Monel" or brass for the ball and gold for the plating and, in fact, the plating may be eliminated altogether.

Figure 11:
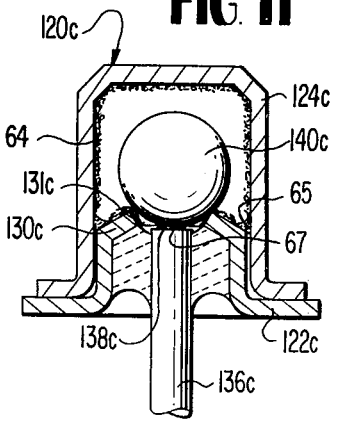
FIG. 11 is a sectional view of yet another modified form of switch in accordance with my invention.
Figure 12:
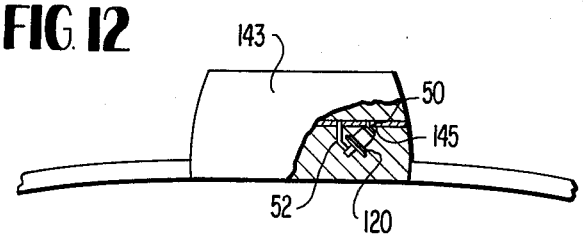
FIG. 12 is a view, on a reduced scale compared to the preceding FIGS. 7–11, representing a switch in accordance with my invention mounted on a printed circuit board in a solid-state wristwatch.

FIG. 11 illustrates still another modified switch designated 120*c*. This switch comprises a header 122*c* and a cap 124*c* generally similar to corresponding elements of the switches of FIGS. 7, 9 and 10, and partakes of other features of each. As the movable element a solid ball 140*c* of conductive material that is unwettable by mercury is employed. The ball is preferably of a refractory metal, as tantalum, tungsten and similar metals which have relatively low electrical resistance and low wettability by liquid metals such as mercury. An electrode 136*c* is provided with a generally flat, mercury-wettable, upper end 138*c*. Although only a small amount of mercury 67 is deposited on the end 138*c*, it should not be depleted when used to switch low currents such as found in digital watches.

In this form of the invention, the interior metal surfaces of the header 122*c* and 124*c* defining the enclosures are made mercury-wettable and are in fact mercury-wetted as indicated at 64. Also mercury-wetted is the edge of the frustoconical header flange 130*c* including the knife-edge 131*c*. It is preferred that the mercury-wetted surfaces be provided by utilizing a thin layer of mercury which covers mercury-wettable metal surfaces in the enclosure for the switch 120*c*, but is inadequate to form a free-flowing pool of mercury regardless of the attitude of the switch. Such concept is discussed in detail in, for example, Donath U.S. Pat. No. 3,144,533 and Bitko U.S. Pat. Nos. 3,646,490 and 3,831,118. However, it will be understood that in certain cases a small quantity of free mercury 65 may be confined in the enclosure to help retain the mercury-wetting of the desired surfaces and elements as specified. As will be appreciated, the free mercury 65 will essentially remain in location due to the high surface tension of mercury.

The switch of FIG. 11 is intended to operate with a rapid acting and precisely controllable, togglelike action, described above, as the switch is moved, to cause movement of the ball about knife-edge 131*c* as a fulcrum. The use of a nonwetting ball 140*c* permits provision of mercury-wetted interior surfaces for the enclosure, including the raised flange perimeter with its knife-edge fulcrum and the flattop of the electrode, to provide low resistance contact surfaces without subjecting the switch to significant retarding forces including friction.

In order to simplify precision mounting of the switch of the present invention in the desired angular relationship relative to a supporting substrate in applications such as watches, whether the substrate be disposed parallel to the watch face as in FIG. 6 or at some other angular position in the wristwatch casing, I prefer to use clips or holders to ensure provision of the correct angular relationships between the enclosure and substrate.

Referring to FIGS. 13 and 14, a preformed metal clip 70 is employed to secure a tilt switch 72, which is preferably constructed in accordance with one of the preferred forms of my invention already described, to a substrate 74 in a wristwatch. The clip 70 is preferably formed of brass, steel or some other conductive metal that can be soldered easily. The clip includes a flat positioning base portion 78 adapted to engage the surface of the substrate 74 and a clamp portion 80 with deformable arms 81 for holding the tilt switch 72 in such position as to bear the precise angular relationship desired to the substrate 74 when flange 78 is in flush engagement therewith. The arms 81 resiliently grip the housing of the switch 72.

The casing of the switch makes electrical contact with the clamp portion 80, thus connecting the outer terminal of the switch to a metallic tab 82 on the clip, which tab extends through an opening in the substrate 74 for connection of the display circuitry. The clip 70 is further provided with a slot 84 through which a lead 86, soldered or otherwise electrically connected to the central electrode of the tilt switch, extends in passing through an opening in the substrate.

The angle $\theta$ between the axis of the switch enclosure and the substrate 74 can be varied by bending the clamp 80 relative to the positioning flange 78.

A modified clip or holder for the tilt switch is shown at 90 in FIGS. 15 and 16. Although this holder may be cast of conductive metal or molded of plastic or like material, the showing of these figures will be described in connection with a die casting, as of a zinc alloy or the like. The holder comprises a flat strip or positioning base member 92, adapted for flat engagement with substrate 74, and a projecting, slotted holder portion 94, with deformable legs 95, having therein a socket 96 for receiving tilt switch 72. The legs 95 resiliently grip the housing of the switch 72, and the casing of the switch makes electrical contact with the surface of the pocket 96. Thus, the outer terminal of the switch 72 is electrically connected through holder portion 94 to a metallic solder tap 98 thereon, which tab extends through an opening in the substrate 74 for making an appropriate electrical connection. The base of holder 90 is formed with an opening 100 therein through which a lead 86*a*, connected to the central electrode, extends in passing through an opening in the substrate.

Where a holder such as 90 of FIGS. 15 and 16 is a plastic part instead of an electrically conductive casting, the tilt switch may be modified to provide a second lead in addition to that connected to the central electrode. Examples of suitable lead arrangements of this type are shown in FIGS. 17–20. In FIGS. 17 and 18, leads 102 and 102*a* are shown welded substantially horizontally and vertically, respectively, to the tops of caps of tilt switches 72. The central electrode is designated 104 in both figures.

In FIG. 19, a lead 102*b* is soldered or welded to flange 126 of the switch, which flange corresponds to the lower outwardly extending flange 126 of the header 22 of the switch shown in FIG. 7.

In FIG. 20, a lead 102*c* is shown extending through central header insulating portion 132 into soldered or welded connection with the underside of the shelf 130 corresponding to the switch elements in the switch of FIG. 7.

From the foregoing description, suitable arrangements for passing the leads through a plastic holder 90 according to the illustration in FIGS. 15 and 16 will be apparent. Both leads can be passed through the opening 100 in the molded holder. It will also be apparent that the clips or holders 70 and 90 may be designed to control the angular relationship of the tilt switch to the substrate in two different directions perpendicular to each other if desired.

FIG. 21 illustrates in perspective a further clip 170 for mounting the switch 72 to the substrate 74 as shown in FIG. 22. A positioning base 178 has a slotted clamp in the form of an eyelet 180 projecting generally perpendicular thereto. The slots in the eyelet facilitate resilient mechanical gripping of the switch 72. The eyelet 180 of the metal clip may be pushed downward over the cap of the switch to a predetermined location so that when the assembly is positioned against the underside of the board 74, the board 74 will rest against the switch and the positioning edge 181 of the clip 170. The solder tab 182 may secure the clip to the board at an angle where this will occur. As the clip is positioned with more or less protrusion of the switch beyond the base 178, the mounting angle will be altered, since the base will be positioned at different angles relative to the substrate 74 after the base is inclined relative to the substrate 74 to bring the switch into contact with the substrate.

If a predetermined mounting angle is desired, the header of the switch can be formed integrally with the positioning base 178*a* so that the axis of the switch is at a fixed angle relative to the positioning base and a fixed distance from the positioning edge 181, such that the desired mounting angle will be realized when the substrate rests against positioning edge 181 and the switch itself. This is shown in FIGS. 23 and 24. An opening 184 through which a lead from the central electrode may pass may be provided in the positioning base.

Although preferred embodiments of the invention have been described in detail, it will be understood that various changes, substitutions, alterations and other modifications may be made therein without departing from the spirit and scope of the invention as defined in the appended claims.

What is claimed is:

1. A tilt switch comprising:

a gravity responsive conductive ball;

housing means defining an enclosure for said gravity responsive conductive ball and including at least one portion of insulative material;

inwardly extending annular shelf means in said enclosure adjacent one end of said housing means;

means defining a depression within said enclosure adjacent said one end of said housing means and surrounded by said annular shelf; contact means including at least one switch contact extending through said at least one portion of insulative material of said housing means and exposed at said depression and further including at least one additional switch contact located within said enclosure and insulated from said at least one switch contact:

said annular shelf means being operable to support said conductive ball in a position where the ball rests against a portion of said housing means projecting beyond said shelf means, with the centroid of said ball located within an imaginery right cylinder having the inner periphery of said shelf means as a base; and said ball being movable in response to the orientation of said switch, to a position unsupported against said portion of said housing means and in contact with both said at least one contact exposed at said depression and said at least one additional switch contact.

2. The tilt switch according to claim 1 wherein:

said at least one additional switch contact also extends through said at least one portion of insulative material of said housing means and is exposed at said depression.

3. The tilt switch according to claim 2 wherein:

said means defining said depression is dimensioned such that said ball is receivable in said depression out of contact with said shelf means.

4. The tilt switch according to claim 1 wherein:

said movable conductive ball is a ball of mercury; and said at least one switch contact comprises a pointed electrode with a mercury-wettable tip.

5. The tilt switch according to claim 1 wherein:

said annular shelf means constitutes said at least one additional switch contact comprising an inwardly sloping ledge terminating in a narrow annular edge; and said movable conductive ball is dimensioned relative to the diameter of said narrow annular edge to preclude passage into said depression completely out of contact with said shelf means.

6. The tilt switch according to claim 5 wherein:

said movable conductive ball is a ball of mercury; and said at least one switch contact comprises a pointed electrode with a mercury-wettable tip.

7. The tilt switch according to claim 1 wherein:

said movable conductive ball is a ball of mercury; and said at least one switch contact comprises a pointed electrode with a mercury-wettable tip.

8. A tilt switch comprising:

a gravity responsive conductive ball;

housing means defining an enclosure for said gravity responsive conductive ball and including at least one portion of insulative material;

annular knife-edge support means disposed in said enclosure adjacent one end of said housing means;

means defining a depression within said enclosure adjacent one end of said housing means and surrounded by said annular knife-edge support means;

contact means including at least one switch contact extending through said at least one portion of insulative material of said housing means and exposed at said depression and further including at least one additional switch contact located within said enclosure and insulated from said at least one switch contact;

said knife-edge support means being operable to support said conductive ball in a position resting against a portion of said housing means projecting beyond said knife-edge support means, with the centroid of said ball located within an imaginary right cylindrical projection of said knife-edge support means;

said ball being movable, in response to orientation of said switch, to a position unsupported against said portion of said housing means in contact with both said at least one contact exposed at said depression and said at least one additional contact.

9. The tilt switch according to claim 8 wherein:

said annular knife-edge support means present a conductive edge constituting said at least one additional contact; and said movable conductive ball has a diameter of a size relative to the diameter of said annular knife-edge precluding passage to said depression completely out of contact with said conductive edge.

10. The tilt switch according to claim 9 wherein:

said movable conductive ball is a ball of mercury.

11. The tilt switch according to claim 10 wherein:

said at least one switch contact comprises a pointed electrode with a mercury-wettable tip.

12. A tilt switch comprising:

a housing defining an enclosure and including a cup-like cap section, and header means connected to said cap section for sealing said enclosure;

said header means including an inwardly extending, peripheral flange portion and a central closure portion of insulating material sealed within said peripheral portion;

said inwardly extending flange portion presenting an inwardly extending annular shelf defining by an inwardly sloping ledge terminating in a narrow annular edge;

said central closure portion being recessed relative to said shelf to define a depression surrounded by said edge;

contct means including at least one electrode extending through said central closure portion of insulating material and exposed at said depression, and at least one additional contact located within said enclosure and insulated from said at least one electrode;

a substantially ball-shaped conductive element in said enclosure movable freely in response to the orientation of the switch between a first position wherein it is not operable to close an electrical circuit between said at least one electrode and said at least one additional contact and a second position wherein it is operable to close and electrical circuit between said at least one electrode and said at least one additional contact;

said conductive element being operable to assume said first position when the switch is oriented within a solid angle including a generally upright position and assuming said second position when the switch is oriented outside said solid angle;

said edge of said ledge constituting fulcrum means for supporting said conductive element in a condition of unstable equilibrium such that said switch is operable to toggle between two states corresponding to said first and second positions;

said conductive element, said cap section and said header section being sized and arranged such that said conductive element is supportable on said edge and in engagement with said cap and out of contact with said at least one electrode when the conductive element is in said second position and that said conductive element is supported on said edge and received by said depression when the conductive element is in said first position.

13. A tilt switch as recited in claim 12 wherein said substantially ball-shaped element is a globule of electrically conducting metal.

14. A tilt switch as recited in claim 13 wherein said liquid conducting metal contains mercury.

15. A tilt switch as recited in claim 13 wherein the interior surfaces of the header and the cap forming the enclosure are substantially nonwettable by the liquid conducting metal.

16. A tilt switch as recited in claim 12 wherein said substantially ball-shaped conductive element is a solid ball of electrically conductive material.

17. A tilt switch as recited in claim 12 wherein said substantially ball-shaped conductive element is a solid ball of electrically conductive material, and said at least one electrode has a pointed tip portion.

18. A tilt switch as recited in claim 17 wherein said ball, tip portion of said electrode and at least a portion of said ledge containing said edge are coated with metal material having low electrical resistance.

19. A tilt switch as recited in claim 18 wherein the metal coating material includes gold.

20. A tilt switch as recited in claim 12 wherein:

the metal surfaces of the header and cap forming the interior of the enclosure are wetted with an electrically conducting liquid metal material including mercury; and said ball-shaped conductive element is a solid ball having a surface of a material that is unwettable by said liquid metal material.

21. A tilt switch comprising:

a gravity responsive conductive ball;

housing means defining an enclosure for said gravity responsive conductive ball;

annular ball support means adjacent one end of said housing;

means defining a depression adjacent said one end of said housing surrounded by said annular ball support means;

contact means including at least one switch contact extending through said housing and exposed at said depression and at least one additional switch contact;

said annular ball support means being operable to support said conductive ball in a position where the ball rests against a portion of said housing means projecting beyond said ball support means, with the centroid of said ball located within an imaginery right cylinder having the inner periphery of said annular ball support means as a base; and said ball being movable in response to the orientation of said switch, to a position unsupported against said portion of said housing means and in contact with both said at least one contact exposed at said depression and said at least one additional switch contact.

* * * * *